United States Patent [19]

Abe et al.

[11] Patent Number: 4,766,427

[45] Date of Patent: Aug. 23, 1988

[54] DISPLAY APPARATUS WITH DISPLAY SCREEN SPLITTING FUNCTION

[75] Inventors: Yoshio Abe, Ibaraki; Masashi Kubota, Katano; Kou Miyake, Takatsuki, all of Japan

[73] Assignee: Matsushita Electric Industrial Co., Ltd., Osaka, Japan

[21] Appl. No.: 787,374

[22] Filed: Oct. 15, 1985

[30] Foreign Application Priority Data

Oct. 15, 1984 [JP] Japan ..... 59-215413

[51] Int. Cl.[4] ..... G09G 1/16

[52] U.S. Cl. ..... 340/721; 340/723; 340/724

[58] Field of Search ..... 340/721, 723, 724, 748, 340/750, 798, 799

[56] References Cited

U.S. PATENT DOCUMENTS

| | | | |
|---|---|---|---|
| Re. 31,200 | 4/1983 | Sukonick et al. | 340/721 |
| 4,107,780 | 8/1978 | Grimsdale et al. | 340/721 |
| 4,317,114 | 2/1982 | Walker | 340/721 |
| 4,618,858 | 10/1986 | Belch | 340/721 |

*Primary Examiner*—Gerald L. Brigance

*Attorney, Agent, or Firm*—Wenderoth, Lind & Ponack

[57] ABSTRACT

A display apparatus for displaying any data on split blocks on a display screen of a CRT. The apparatus comprises a circuit for producing a horizontal address and a vertical address of a display position on the display screen; a block address generator comparing the horizontal and vertical addresses of the display position with predetermined horizontal split addresses and vertical split addresses for generating a block address which shows one of the split blocks on the display screen according to the comparison result; a code converter for converting the block address to a predetermined code; a memory start address generator for generating a memory start address according to the code outputted from the code converter; a memory address generator for generating a memory address from the memory start address and the horizontal and vertical addresses of the display position; a display memory storing display data and output the display data according to the memory address; and a display monitor for displaying the display data outputted from the display memory on the CRT.

23 Claims, 6 Drawing Sheets

FROM BLOCK ADDRESS GENERATOR
XS0
XS1
YS0
YS1
36
16
CODE CONVERTER
BLOCK MEMORY
37
A0
A1
A2
A3
D0
D1
38
17
MEMORY START ADDRESS GENERATOR
MEMORY START ADDRESS DATA MEMORY
39
A0
A1
D0-D19
MSA0-MSA19
40
18
DISPLAY MEMORY ADDRESS GENERATOR
RELATIVE ADDRESS ADDER
41
A0-A7
A8-A15
Q0-Q15
B0-B15
42
ABSOLUTE ADDRESS ADDER
43
A0-A19
B0-Q0-B15Q19
B16-B19
44
DA0-DA19
20
DISPLAY MEMORY 19
45
A0-D0-A19D7
DD0-DD7
TO SHIFT REGISTER
22
X0-X7
27
YA0-YA15
8
16
4
20

FIG. 6a

DISPLAY SCREEN

| | aa | bb | cc | | YS1 | YS0 |
|---|---|---|---|---|---|---|
| | BLOCK 0 | BLOCK 1 | BLOCK 2 | BLOCK 3 | 0 | 0 |
| dd | BLOCK 4 | BLOCK 5 | BLOCK 6 | BLOCK 7 | 0 | 1 |
| ee | BLOCK 8 | BLOCK 9 | BLOCK 10 | BLOCK 11 | 1 | 0 |
| ff | BLOCK 12 | BLOCK 13 | BLOCK 14 | BLOCK 15 | 1 | 1 |
| XS0 | 0 | 1 | 0 | 1 | | |
| XS1 | 0 | 0 | 1 | 1 | | |

FIG. 6b

HORIZONTAL SPLIT DATA MEMORY

| ADDRESS | DATA |
|---|---|
| 0 | aa |
| 1 | bb |
| 2 | cc |

FIG. 6c

VERTICAL SPLIT DATA MEMORY

| ADDRESS | DATA |
|---|---|
| 0 | dd |
| 1 | ee |
| 2 | ff |

FIG. 6e

MEMORY START ADDRESS DATA MEMORY

| ADDRESS | DATA |
|---|---|
| 0 | ggggg |
| 1 | hhhhh |
| 2 | iiiii |
| 3 | jjjjj |

FIG. 6d

CODE CONVERSION MEMORY (BLOCK MEMORY)

| ADDRESS | DATA |
|---|---|
| 0 | 0 |
| 1 | 0 |
| 2 | 0 |
| 3 | 0 |
| 4 | 0 |
| 5 | 1 |
| 6 | 1 |
| 7 | 2 |
| 8 | 2 |
| 9 | 1 |
| 10 | 1 |
| 11 | 2 |
| 12 | 3 |
| 13 | 3 |
| 14 | 3 |
| 15 | 2 |

DISPLAY APPARATUS WITH DISPLAY SCREEN SPLITTING FUNCTION

BACKGROUND OF THE INVENTION

1. Field of the Invention

The present invention relates to a display apparatus used for a display terminal of general computer systems, microcomputer systems, and the like, and more particularly to a raster scan type display apparatus for displaying graphics and characters.

2. Description of the Prior Art

Recently, with the spread of computers and microcomputers, raster scan type display apparatuses using a cathode ray tube (CRT) or the like have become widely used for their display terminals. In the raster scan type display apparatus using a CRT or the like, a picture is displayed on the screen from the upper left-hand corner of the display screen by sequentially accessing display memory addresses.

Conventionally, the display apparatus using an ordinary raster scan type CRT comprises a timing generator, a display memory address generator, a display memory, a shift register, and a display monitor. The timing generator generates a horizontal clock, a horizontal synchronizing clock, and a vertical synchronizing clock. The display memory address generator generates a display memory address from the horizontal clock, horizontal synchronizing clock, and vertical synchronizing clock. Display data are read out from the display memory with the display memory address applied thereto and are converted from parallel form into serial form by a shift register to be outputted to the display monitor. The display memory address generator is composed of a horizontal counter which is reset by the horizontal synchronizing clock and counts the horizontal clock, and a vertical counter which presets a display start address stored in a vertical preset register address by the vertical synchronizing clock, and counts the horizontal synchronizing clock, and outputs the values of the horizontal counter and vertical counter as the display memory address to the display memory.

Operation of the above described conventional apparatus will be explained in the following. First, at a display start position (the upper left corner on the display screen) the horizontal counter is reset by the horizontal synchronizing clock, and the horizontal counter is preset with the display start address stored in the vertical preset register by the horizontal synchronizing clock. The horizontal counter counts up to a predetermined memory width during a horizontal scanning period. When the count value of the horizontal counter becomes a predetermined value corresponding to the predetermined memory width in one horizontal scanning period, the horizontal counter is again reset by the horizontal synchronizing clock and the vertical counter is counted up by one by the horizontal synchronizing clock. This process is sequentially repeated until the display position reaches a display end position (the lower right corner on the display screen).

When the display position has reached the display end position, the vertical counter is preset with the display start address stored in the vertical preset register by the vertical synchronizing clock, and the above scanning process is restarted.

In the above described arrangement, it will be possible only to vertically scroll the displayed picture by sequentially changing the value stored in the vertical preset register. However, the conventional, display apparatus cannot offer more complex display functions such as the panning display which freely displays any portions of a larger display memory, the split-screen display, the function that each of the split screens is freely arranged for graphic display and character display, and the window display.

SUMMARY OF THE INVENTION

An object of the present invention is to provide a raster scan type CRT display apparatus which has functions of horizontally split screen display, vertically split screen display, or both horizontally and vertically split, or latticed, screen display.

Another object of the invention is to provide a raster scan type CRT display apparatus which has a function of panning display of the split screens.

A further object of the invention is to provide a raster scan type CRT display apparatus which has a function of displaying either of graphics and characters freely on any of the split screens.

In order to achieve these objects, a display apparatus of the invention comprises means for producing a horizontal address and a vertical address of a display position on a display screen; block address generating means comparing the horizontal and vertical addresses of the display position with predetermined horizontal split addresses and vertical split addresses for generating a block address which shows one of split blocks on the display screen according to the comparison result; code conversion means for converting the block address to a predetermined code; memory start address generating means for generating a memory start address according to the code outputted from the code conversion means; memory address generating means for generating a memory address from the memory start address and the horizontal and vertical addresses of the display position; a display memory storing display data and output the display data according to the memory address; and means for displaying the display data outputted from the display memory on a CRT.

With this configuration, any part of display data in the display memcry can be displayed on any of the split blocks on the display screen of the CRT. The panning display on each split block can be easily realized by continuously renewing each memory start address corresponding to each split block. Further the memory start address generating means may generates a character/graphic display switching code, and the display apparatus may further comprises a character data generating means for generating character data and character/graphic selection means responsive to the character/graphic display switching code for selecting either the display data from the display memory or the character data.

Based on the above features of the invention, a preferable display apparatus of the invention comprises: a timing generator for generating a horizontal clock, a horizontal synchronizing clock and a vertical synchronizing clock; a horizontal address counter counting the horizontal clock for generating a horizontal address; a vertical line counter counting the horizontal synchronizing clock for generating a vertical line count value; a vertical address generator responsive to the horizontal synchronizing clock for generating a vertical address; a block address generator comparing the horizontal address and the vertical line count value with predetermined split coordinate values for generating a block address; a code converter encoding the block address for generating a converted code; a memory start address generator for generating a memory start address according to the converted code; a display memory address generator for generating a display memory address from the horizontal address, vertical address and the memory start address; a display memory storing display data; a shift register converting the display data outputted from the display memory into serial display data; and a display monitor for displaying the serial display data on a CRT display.

Further, another preferable display apparatus of the invention comprises: a timing generator for generating a horizontal clock, a horizontal synchronizing clock and a vertical synchronizing clock; a horizontal address counter counting the horizontal clock for generating a horizontal address; a vertical line counter counting the horizontal synchronizing clock for generating a vertical line count value; a vertical address generator responsive to the horizontal synchronizing clock for generating a vertical address; a character vertical address generator for generating a character row address and a character vertical address from the horizontal synchronizing clock; a block address generator comparing the horizontal address and the vertical line count value with predetermined split position values for generating a block address; a code converter encoding the block address for generating a converted code; a memory start address generator for generating a memory start address and a character/graphic display switching code according to the converted code; a first selector for selecting one of the vertical address and the character vertical address according to the character/graphic display switching code for outputting a character/graph vertical address; a display memory address generator for generating a display memory address from the horizontal address, character/graph vertical address and the memory start address; a display memory storing display data and character codes; a first shift register for converting the display data from the display memory into serial display data; a character generator for outputting a character font according to the character row address and a character code outputted from thedisplay memory; a second shift register for converting the character font outputted from the character generator into serial character data; a second selector for selecting one of the output of the first shift register and the output of the second shift register according to the character/graphic display switching code and outputting the selected data; and a display monitor for displaying the selected data on a CRT display.

The above and other objects, features and advantages of the invention will be apparent from the following description taken in connection with the accompanying drawings in which:

BRIEF DESCRIPTION OF THE DRAWINGS

FIGS. 6*a* to 6*e* are schematic explanatory diagrams for showing relationships among a display screen, a horizontal split data memory, a vertical split data memory, a block memory, and a memory start address data memory;

DESCRIPTION OF THE PREFERRED EMBODIMENT

Preferred embodiment of the present invention will be described in the following with reference to the accompanying drawings.

Figure 1:
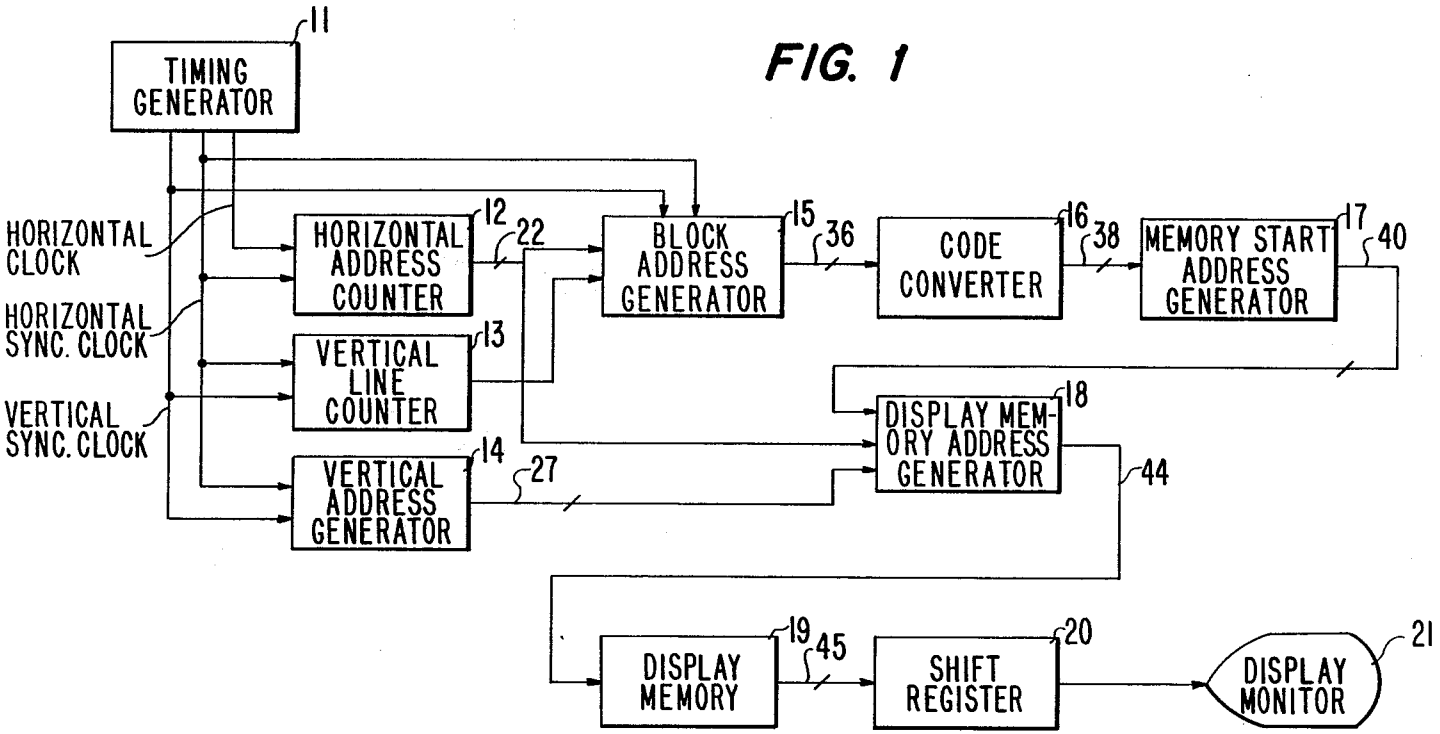
FIG. 1 is a block diagram of a first preferred embodiment of the invention.

FIG. 1 is a block diagram of a display apparatus of a first embodiment of the invention. Referring to FIG. 1, 11 denotes a timing generator, 12 denotes a horizontal address counter, 13 denotes a vertical line counter, 14 denotes a vertical address generator, 15 denotes a block address generator, 16 denotes a code converter, 17 denotes a memory start address generator, 18 denotes a display memory address generator, 19 denotes a display memory, 20 denotes a shift register, and 21 denotes a display monitor The timing generator 11 generates a horizontal clock, horizontal synchronizing clock, and a vertical synchronizing clock.

Figure 2:
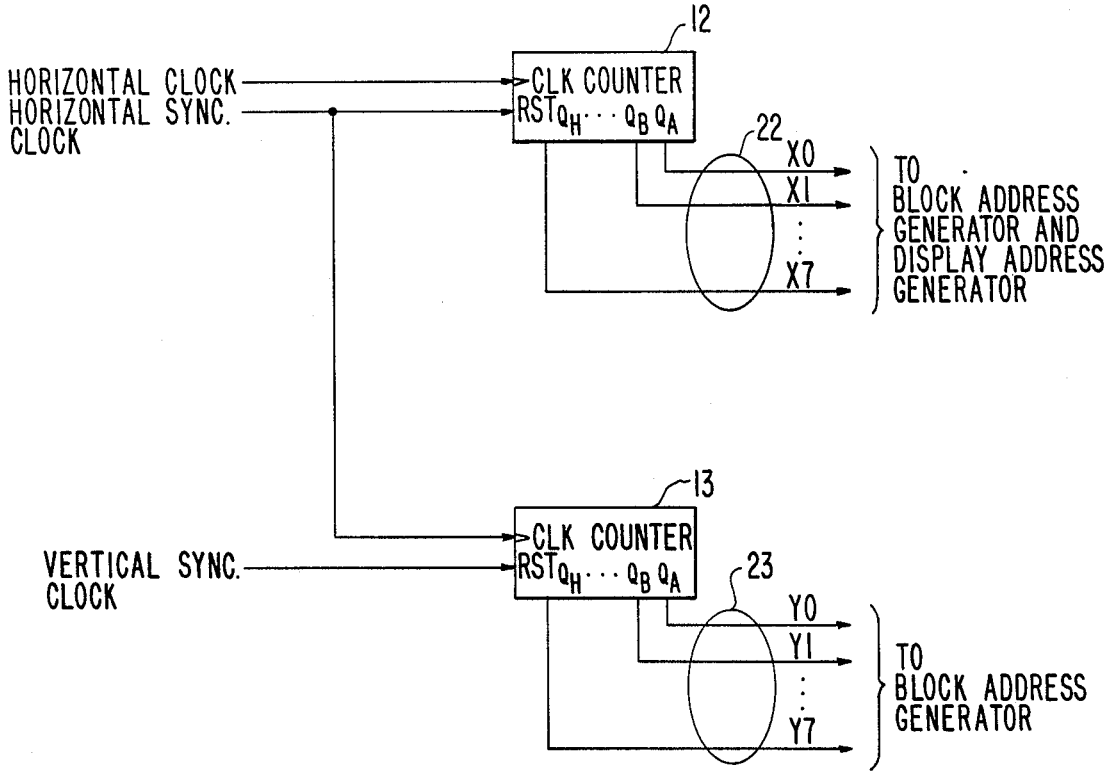
FIG. 2 is a block diagram of a horizontal address counter and a vertical line counter.

The horizontal address counter 12,as shown in FIG. 2, is reset by the horizontal synchronizing clock, counts the horizontal clock, and outputs a horizontal address (X7−X0) 22 indicating a display position in the horizontal direction to the block address generator 15 and the display memory address generator 18.

The vertical line counter 13,as shown in FIG. 2, is reset by the vertical synchronizing clock, counts the horizontal synchronizing clock, and outputs a vertical line count value (Y7−Y0) 23 indicating a display position in the vertical direction to the block address generator 15.

Figure 3:
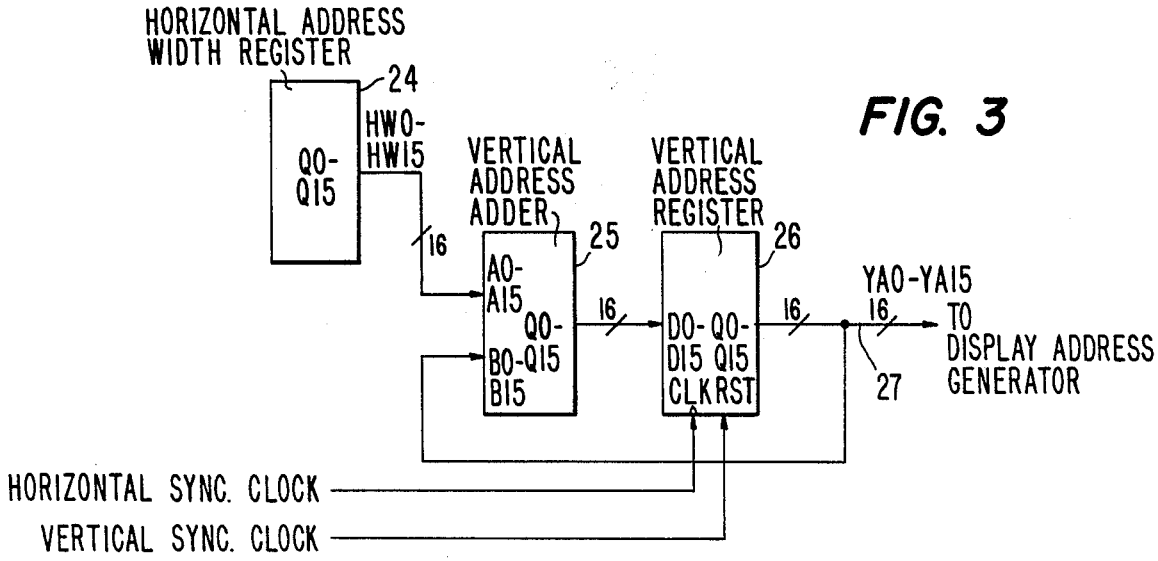
FIG. 3 is a block diagram of a vertical address generator.

The vertical address generator 14, as shown in FIG. 3, consists of a display memory horizontal address width register 24, a vertical address adder 25, and a vertical address register 26. The vertical address adder 25 adds the value of the horizontal address width register 24 in which a horizontal address width (HW15−HW0) is previously established and the value of the vertical address register 26. The vertical address register 26, which is a register to be reset by the vertical synchronizing clock and to hold the value of the vertical address adder 25 in synchronization with the horizontal synchronizing clock, supplies a vertical address (YA15−YA0) 27, i.e., the output of the vertical address register 26, to the display memory address generator 18.

Figure 4:
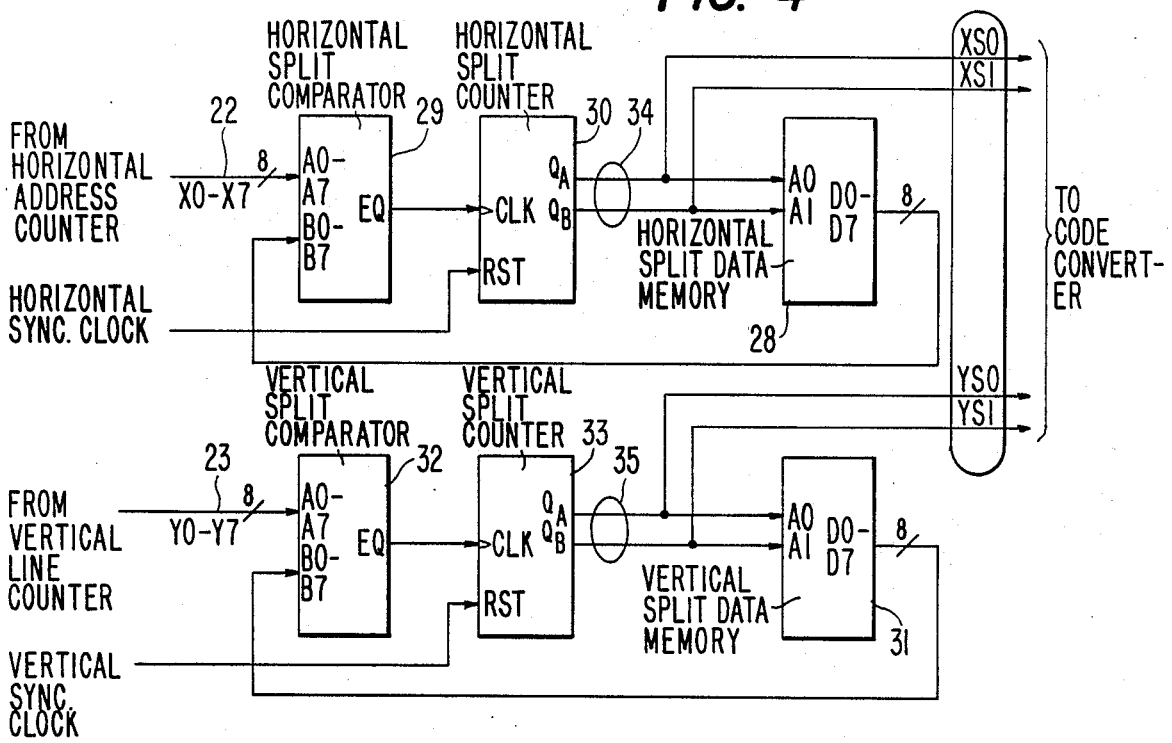
FIG. 4 is a block diagram of a block address generator.
Figure 4:
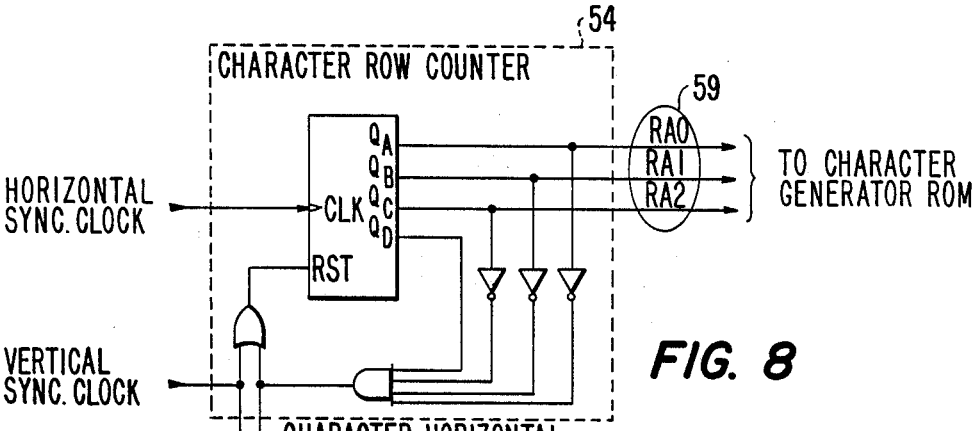

The block generator 15, as shown in FIG. 4, consists of a horizontal split data memory 28, a horizontal split comparator 29, a horizontal split counter 30, a vertical split data memory 31, a vertical split comparator 32, and a vertical split counter 33.

First, splitting operation of the block address generator 15 in the horizontal direction will be described in the following. In the horizontal split data memory 28, there are established a first horizontal split coordinate value at address 0, a second horizontal split coordinate value at address 1, and succeeding horizontal split coodinate values at succeeding addresses in the like manner Each horizontal split coordinate value is read out from the horizontal split data memory 28 when a horizontal split position value 34 is applied thereto as the address, and supplied to one input port of the horizontal split comparator 29. The horizontal split comparator 29, which is supplied at the other input port thereof with a horizontal address 22 outputted from the horizontal address counter 12, compares the output of the horizontal split data memory 28 with the horizontal address 22, and when these coincide with each other outputs a coincidence pulse. The horizontal split counter 30 counts up upon receipt of the coincidence pulse. In this arrangement, the horizontal split counter 30 reset by the horizontal synchronizing clock outputs a value "0" as the horizontal split position value 34, and the horizontal split data memory 28 outputs the first horizontal split coordinate value at address 0. The horizontal split comparator 29 compares the horizontal address 22 with the first horizontal split coordinate value, and if these coincide with each other the comparator 29 outputs a coincidence pulse to the horizontal split counter 30. The horizontal split counter 30 counts up and outputs a value "1" as the next horizontal split position value 34. Through repetition of the above described process at a horizontal scanning period, the horizontal split position values 34 are obtained.

Next, the splitting operation of the block address generator 15 in the vertical direction will be described. In the vertical split data memory 31, there are established a first vertical split coordinate value at address 0, a second vertical split coordinate value at address 1, and succeeding vertical split coordinate values at succeeding addresses in the like manner. Each vertical split coordinate value is read out from the vertical split data memory 31 when a vertical split position value 35 is applied thereto as the address, and supplied to one input port of the vertical split comparator 32. The vertical split comparator 32, which is supplied at the other input port thereof with a vertical line count value 23 outputted from the vertical line counter 13, compares the output of the vertical split data memory 31 with the vertical line count value 23, and when these coincide with each other outputs a coincidence pulse. The vertical split counter 33 counts up upon receipt of the coincidence pulse. In this arrangement, the vertical split counter 33 reset by the vertical synchronizing clock outputs a value "0" as the vertical split position value 35, and the vertical split data memory 31 outputs the first vertical split coordinate value at address 0. The vertical split comparator 32 compares the vertical line count value 23 with the first vertical split coordinate value, and if these coincide with each other the comparator 32 outputs a coincidence pulse to the vertical split counter 33. The vertical split counter 33 counts up and outputs a value "1" as the next vertical split position value 35. Through repetition of the above described process at a vertical scanning period, the vertical split position values 35 are obtained.

The block address generator 15 operating as described above outputs to the code converter 16 a block address (YS1, YS0, XS1, XS0) 36 consisting of the horizontal split position value 34 as a lower address and the vertical split position value 35 as an upper address.

Figure 5:
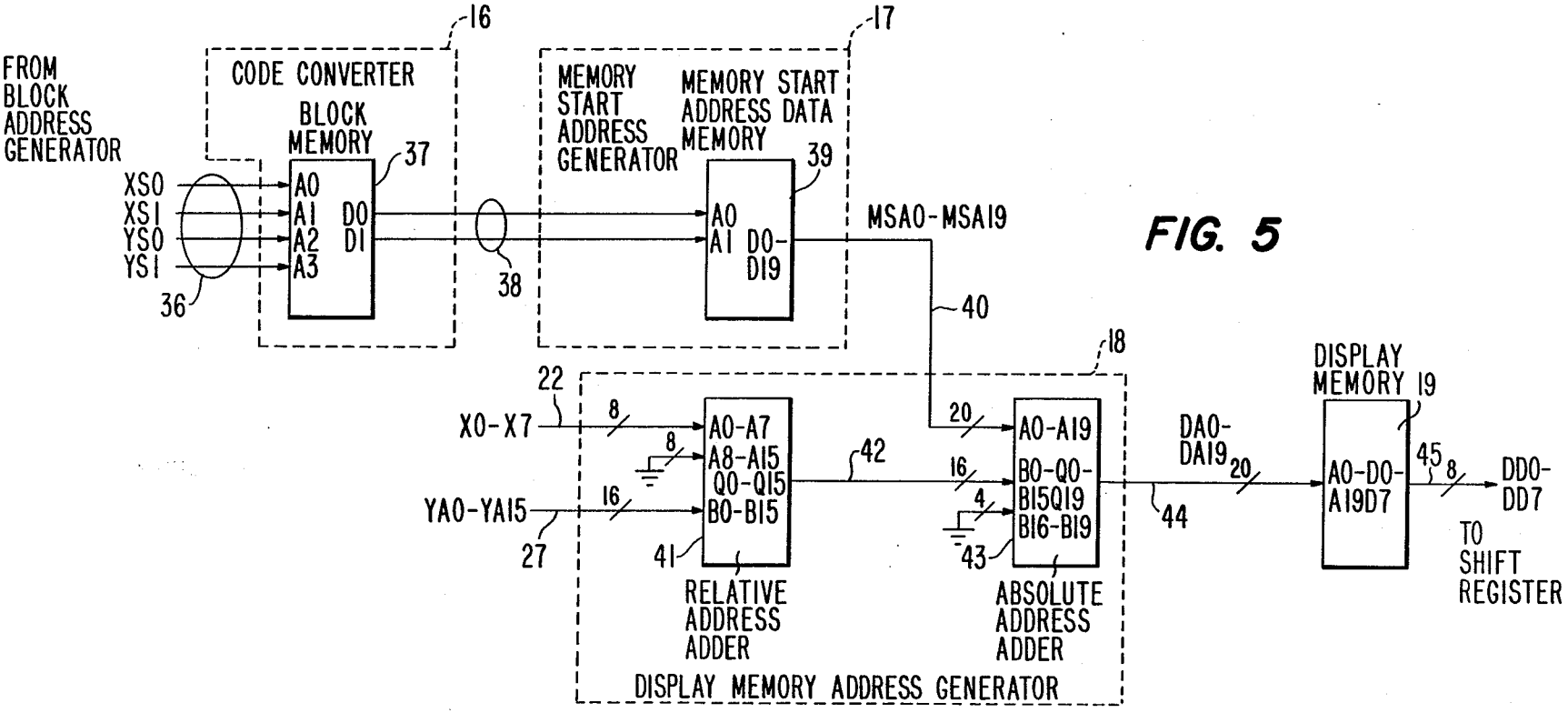
FIG. 5 is a block diagram of a code converter, a memory start address generator, a display address generator, and a display memory.

The code converter 16, as shown in FIG. 5, is composed of a block memory 37 which stores predetermined codes and outputs as a converted code 38 one of the predetermined codes which is stored at an address specified by the block address 36 outputted from the block address generator 15.

The display memcry start address generator 17, as shown in FIG. 5, is composed of a memory start address data memory 39 which stores at least two predetermined memory start address values and outputs as a memory start address (MSA19—MSA0) 40 one of the predetermined memory start address values which is specified by the converted code 38 outputted from the code converter 16. The memory start address 40 is supplied to the display memory address generator 18.

The display memory address generator 18, as shown in FIG. 5, is composed of a relative address adder 41 for adding the horizontal address 22 outputted from the horizontal address counter 12 and the vertical address 27 outputted from the vertical address generator 14 thereby to produce a relative address 42, and an absolute address adder 43 for adding the relative address 42 and memory start address 40 thereby to produce a display memory address (DA19—DA0) 44 which is outputted to the display memory 19.

The display memory 19 receives the display address 44 from the display address generator 18 and outputs a display data (DD7—DD0) 45 in bit-parallel to the shift register 20. The shift register 20 in turn converts the display data 45 into bit-serial data to be displayed on the display monitor 21.

The operation of display apparatus as described above will be explained with reference to FIG. 6. FIG. 6 shows an example that the display screen is horizontally split into four and vertically split into four. The display screen is thus divided into 16 blocks, BLOCK 0–BLOCK 15. The horizontal split coordinate values are designated aa, bb and cc, and the vertical split coordinate values are designated dd, ee and ff.

First, the splitting operation in the horizontal direction will be explained. The horizontal split counter 30 reset by the horizontal synchronizing clock outputs the horizontal split position value 34 as "0" until the value of the horizontal address 22 reaches the value aa. When the value of the horizontal address 22 reaches the value aa, the coincidence signal outputted from the horizontal split comparator 29 is supplied to the horizontal split counter 30, so that the horizontal split counter 30 counts up and changes the horizontal split position value 34 to "1". Taking the same steps, the horizontal split position value 34 is kept "1" while the horizontal address value 22 is between aa and bb, "2" while the horizontal address value 22 is between bb and cc, and "3" while the horizontal address value 22 is between cc and the end horizontal address. The above operations are repeated for each horizontal scanning period.

Next, the splitting operation in the vertical direction will be explained. The vertical split counter 33 reset by the vertical synchronizing clock outputs the vertical split position value 35 as "0" until the value of the vertical line count value 23 reaches the value dd. When the value of the vertical line count value 23 reaches the value dd, the coincidence signal outputted from the vertical split comparator 32 is supplied to the vertical split counter 33, so that the vertical split counter 33 counts up and changes the vertical split position value 35 to "1". Taking the same steps, the vertical split position value 35 is kept "1" while the vertical line count value 23 is between dd and ee, "2" while the vertical line count value 23 is between ee and ff, and "3" while the vertical line count value 23 is between ff and the end vertical line count value. The above operations are repeated for each vertical scanning period.

At this time, the horizontal split data memory 28 is set up as shown in FIG. *6b* and the vertical split data memory 31 is set up as shown in FIG. *6c*.

Now, the value of the block address 36 is "0" in BLOCK 0 shown in FIG. *6a*, "1" in BLOCK 1, and likewise from "2" to "15" in BLOCKs 2 to 15. The block memory 37 may store predetermined converted codes as many as the number of the split blocks (16 in this case). The converted code 38 in the block memory 37, as shown in FIG. *6d* for example, is read out by applying thereto the block address 36, and supplied to the memory start address generator 17. The memory start address data memory 39 of the memory start address generator 17, which stores memory start address data as shown in FIG. *6e*, outputs the memory start address 40 according to the converted code 38 applied thereto as the address. Here, the range of the values of the converted codes stored in the block memory 37 is determined by the number of the memory start addresses stored in the memory start address data memory 39. In this embodiment, since the number of the memory start addresses stored in the memory start address data memory 39 is four, the range of the values of the converted codes is from 0 to 3.

As described above, the memory start address 40 is outputted for each block, the relative address 42 and the display memory address 44 are produced in the display memory address generator 18, and the display memory address 44 is supplied to the display memory 19, whereby the display data 45 in any region in the display memory 19 can be read out for each block on the display screen.

According to the embodiment as described above, the horizontal split positions can be freely set by changing the horizontal split coordinate values in the horizontal split data memory 28 (for example, aa, bb, and cc in FIG. *6a*), and also the vertical split positions can be freely set by changing the vertical split coordinate values in the vertical split data memory 31 (for example, dd, ee, and ff in FIG. *6a*), so that the display screen can be freely split in a latticed form.

Further, the contents of the display on the split blocks on the display screen can be freely selected by establishing the addresses of the memory start address data memory 39 of the memory start address generator 17 at will in the block memory 37 of the code converter 16 as shown in FIG. *6d*.

Furthermore, by successively updating the values of the memory start address data memory 39 of the memory start address generator 17 with time, the present embodiment enables panning displays on all of those blocks for which the address of the memory start address data memory 39 being in the updating process is established as the value of the block memory 37.

Next, a second preferred embodiment of the invention will be described referring to the accompanying drawings.

Figure 7:
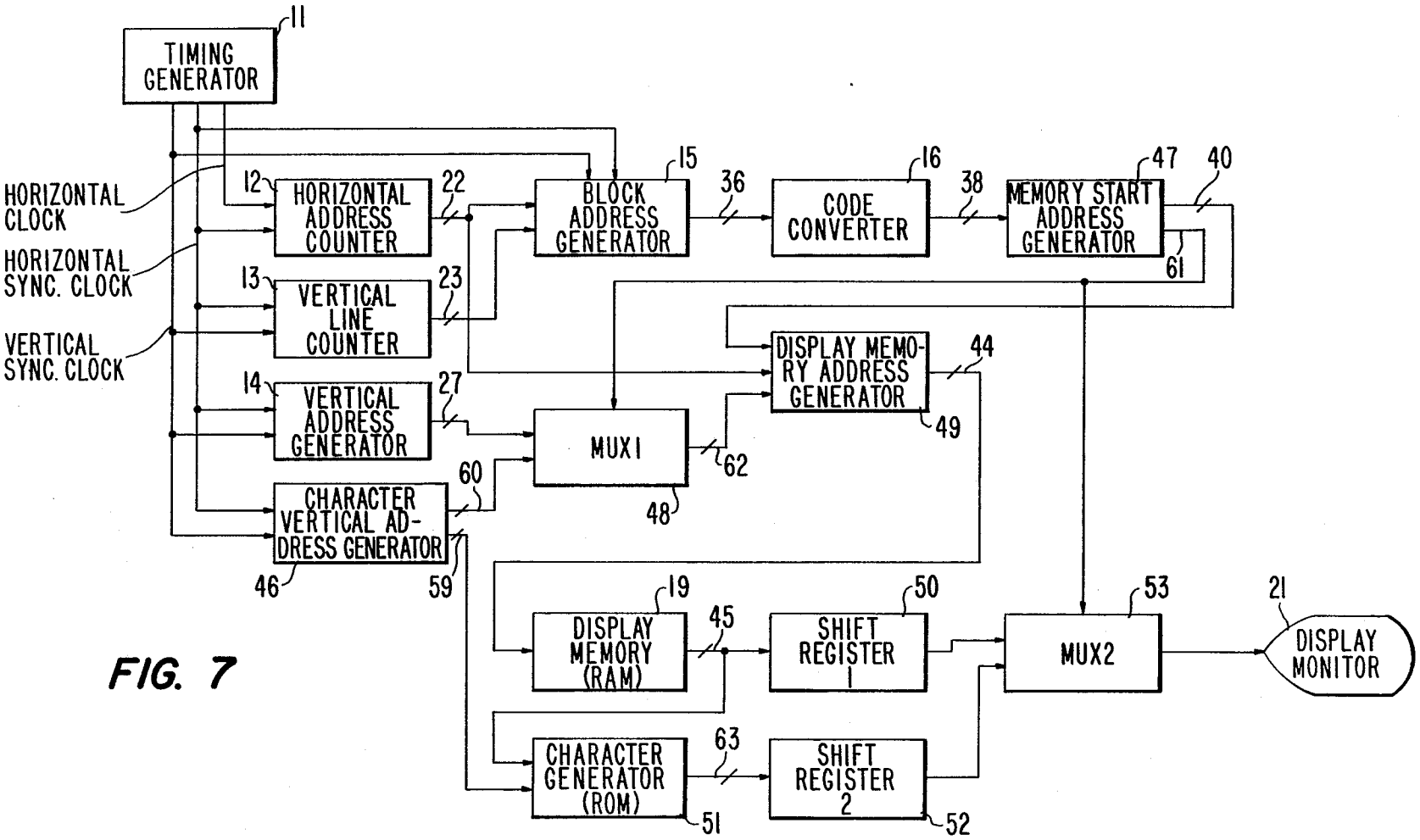
FIG. 7 is a block diagram of a second preferred embodiment of the invention.

FIG. 7 is a block diagram of a display apparatus of the second embodiment of the invention. Referring to FIG. 7, 11 denotes a timing generator, 12 denotes a horizontal address counter, 13 denotes a vertical line counter, 14 denotes a vertical address generator, 15 denotes a block address generator, 16 denotes a code converter, 19 denotes a display memory, and 21 denotes a display monitor, but descriptions of these parts are omitted here since these parts are already shown in FIG. 1 and descriptions of the same are already made. In FIG. 7, 46 denotes a character vertical address generator, 47 denotes a memory start address generator, 48 denotes a first multiplexer (MUX1), 49 denotes a display memory address generator, 50 denotes a first shift register, 51 denotes a character generator ROM, 52 denotes a second shift register, and 53 denotes a second multiplexer (MUX2).

Figure 8:
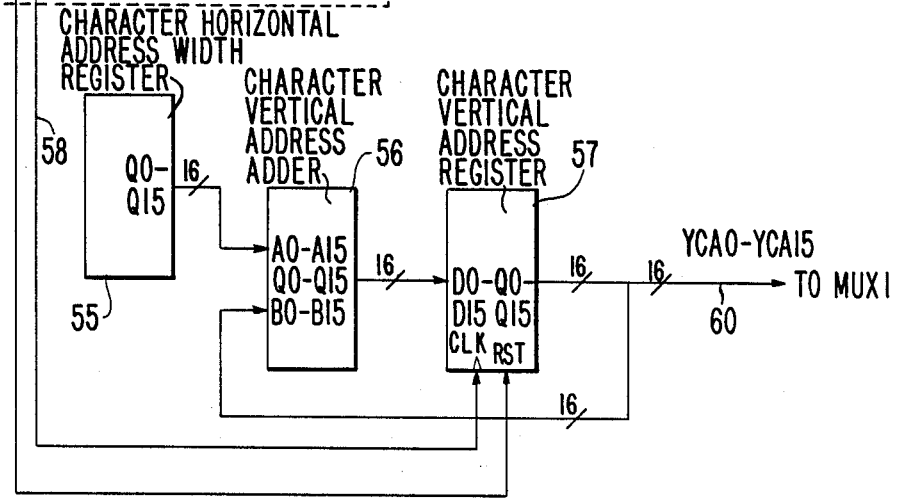
FIG. 8 is a block diagram of a character vertical address generator.

The character vertical address generator 46, as shown in FIG. 8, consists of a character row counter 54, a character horizontal address width register 55, a character vertical address adder 56, and a character vertical address register 57. The character row counter 54, which is a counter counting a horizontal synchronizing clock for generating a character row address (RA2—RA0) 59, outputs a character pulse 58 and simultaneously resets itself each time when counted up the number of rows of a character. (In this case, the number of rows is eight.) The count output of the character row counter 54 is supplied as the character row address 59 to the character generator ROM 51. The character address adder 56 adds the value of the character horizontal address width register 55 in which a predetermined character horizontal address width is set with the value of the character vertical address register 57. The character vertical address register 57, which is a register reset by a vertical synchronizing clock and holds the value of the character vertical address adder 56 each time the character pulse 58 is inputted thereto, supplies its output, i.e., a character vertical address (YCA15—YCA0) 60, to the first multiplexer (MUX1) 48.

The memory start address generator 47, composed of a data memory which stores at least two predetermined sets of memory start address values and character/graphic display switching codes, reads out a memory start address 40 and a character/graphic display switching code 61 stored in the data memory when the converted code 38 outputted from the code converter 16 is applied thereto as the address. The memory start address 40 is supplied to the display memory address generator 49 and the character/graphic display switching code 61 is supplied to both the first multiplexer (MUX1) 48 and the second multiplexer (MUX2) 53.

The first multiplexer (MUX1) 48 selects either the vertical address 27 from the vertical address generator 14 or the character vertical address 60 from the character address generator 46 according to the character/graphic display switching code 61, and supplies the selected one as a character/graph vertical address 62 to the display memory address generator 49.

The display memory address generator 49 is the same in operation as the display memory address generator 18 in the earlier described first embodiment except that this generator 49 receives the character/graph vertical address 62 instead of the vertical address 27 in the earlier case. The generator 49 outputs the display memory address 44 to the display memory 19.

The first shift register 50, which is the same in operation as the shift register 20 in the earlier described first embodiment, converts the display data 45, i.e., the output of the display memory 19, into serial data to be supplied to the second multiplexer (MUX2) 53.

The character generator ROM 51, which is a ROM storing character font data, outputs character font data 63 read therefrom in bit-parallel when the character row address 59 is applied thereto as the character row address and the display data 45 is applied thereto as the character address. The character font data 63 is supplied to the second shift register 52.

The second shift register 52 converts the character font data 63 from the character generator ROM 51 into bit-serial data to be supplied to the second multiplexer (MUX2) 53.

The second multiplexer (MUX2) 53 selects either the output of the first shift register 50 or the output of the second shift register 52 according to the character/graphic display switching code 61, and supplies the selected one to the display monitor 21.

Operation of the display apparatus arranged as above will be described in the following. The converted code 38 generated by the code converter 16 in the same manner as in the first embodiment is a signal provided for each of the horizontally and vertically split blocks and supplied to the memory start address generator 47. The memory start address generator 47 reads therefrom, with the converted code 38 applied thereto as the address, the bit-parallel memory start address 40 and the character/graphic display switching code 61 at the same time. The character/graphic display switching code 61 is used as a signal to specify which of a graphic display and a character display should be made on the specified block on the display screen, and, in the same way as the memory start address 40, can be set for each block by means of the converted code 38.

Here, for example, the character/graphic display switching code 61 is assumed to be "0" for a graphic display and "1" for an alphanumeric character display. If the character/graphic display switching code 61 is "0", the first multiplexer (MUX1) 48, receiving the vertical address 27 and the character vertical address 60, selects the vertical address 27 and outputs the same as the character/graph vertical address 62 to the display memory address generator 49, and the second multiplexer (MUX2) 53, receiving the output of the first shift register 50 and the output of the second shift register 52, selects the output of the first shift register 50 and outputs the same to the display monitor 21, so that a graphic display is made. If the character/graphic display switching code 61 is "1", the first multiplexer (MUX1) 48, receiving the vertical address 27 and the character vertical address 60, selects the character vertical address 60 and outputs the same as the character/graph vertical address 62 to the display memory address generator 49, and the second multiplexer (MUX2) 53, receiving the output of the first shift register 50 and the output of the second shift register 52, selects the output of the second shift register 52 and outputs the same to the display monitor 21, so that a character display is made.

According to the second embodiment as described above, additional function to those described with reference to the first embodiment can be performed. That is, by establishing at least two sets of memory start address values and character/graphic display switching code values in the memory start address generator 47, reading out the converted code for each of the split blocks, and obtaining the memory start address as well as the character/graphic display switching code from the converted code, either of the graphic display and the character display can be performed at will on each of the split blocks.

The number of horizontal and vertical splits on the display screen, the size of the block memory, and the size of the memory start address data memory, used in the above description of the first and second embodiment are merely examples, and the present invention is not limited with regard to such number and size.

Further, it should be understood that the whole configuration of the apparatus and the configuration of each of the construction elements may be changed or modified within the scope of the invention.

What is claimed is:

1. A display apparatus comprising:

a raster scan display means having a display screen split by predetermined horizontal split positions and vertical split positions into a plurality of split blocks which are respectively identified by block address which are sequentially coded numbers assigned sequentially to said pluraity of split blocks;

display memory for storing display data to be displayed on said display screen;

a means for producing a current display address indicating a current display position on said display screen;

a block address generating means for comparing said current display address with predetermined values indicating said horizontal and vertical split positions, and for generating from the comparison result a current block address indicating one of said plurality of split blocks in which said current display position exists;

a code conversion means for converting said current block address to a predetermined code corresponding to a predetermined memory area in said display memory in which display data to be displayed in the split block identified by said current block address are stored;

a memory start address generating means for generating a start address of said predetermined memory area in said display memory according to said predetermined code; and a memory address generating means for adding said start address and said current display address to generate a memory address in said predetermined memory area in said display memory, said generated memory address being supplied to said display memory so that display data stored in said memory address is transmitted from said display memory to said display means and displayed on said current display position on said display screen;

whereby display data to be displayed in each of said plurality of split blocks on said display screen are supplied from a predetermined one of a plurality of memory areas defined in said display memory.

2. An apparatus according to claim 1, wherein said block address generating means has a memory for storing said predetermined values indicating said horizontal and vertical split positions.

3. An apparatus according to claim 1, wherein said code conversion means comprises a memory for storing a predetermined one of a plurality of codes which respectively corresponding to said plurality of memory areas defined in said display memory in each of addresses which are defined in said block address.

4. An apparatus according to claim 3, wherein said memory start address generating means comprises a memory for storing start addresses of said plurality of memory areas in addresses defined by said plurality of codes, respectively.

5. An apparatus according to claim 4, wherein said memory start addresses stored in said memory of said memory start address generating means are variable.

6. An apparatus according to claim 3, wherein said predetermined one of said plurality of codes stored in each of said addresses in said memory of said code conversion means is variable.

7. An apparatus according to claim 1 further comprising character data generating means for generating character data, and selection means for selecting one of said display data from said display memory and said character data from said character data generating means and supplying the selected data to said display means.

8. An apparatus according to claim 7, wherein said memory start address generating means further generates a display switching code together with said memory start address, and said selection means is responsive to said display switching code for selecting one of said display data and said character data.

9. A display apparatus comprising:

a raster scan display means having a display screen split by predetermined horizontal split positions and vertical split positions on said display screen into a pluraity of split blocks which are respectively identified by block addresses which are sequentially coded numbers assigned sequentially to said plurality of split blocks;

a display memory for storing display data to be displayed on said display screen;

a timing generator for generating a horizontal clock, a horizontal synchronizing clock, and a vertical synchronizing clock;

a horizontal address counter which is reset by said horizontal synchronizing clock and which counts said horizontal clock for generating a current horizontal address of a current display position on said display screen;

a vertical line counter which is reset by said vertical synchronizing clock and which counts said horizontal synchronizing clock for generating a current vertical line count value indicating a current horizontal scanning line on which said current display position exists;

a vertical address generator which is reset by said vertical synchronizing clock and which generates a current vertical address of said current display position on said display screen which is increased by a value equal to a horizontal address width in response to said horizontal synchronizing clock;

a block address generator for comparing said current horizontal address with predetermined values indicating said horizontal split positions and for comparing said current vertical line count value with predetermined values indicating said vertical split positions, and for generating from the comparision result a current block address indicating one of said plurality of split blocks in which said current display position exists;

a code converter for converting said current block address to a predetermined code corresponding to a predetermined memory area in said display memory in which display data to be displayed in the split block identified by said current block address are stored;

a memory start address generator for generating a start address of said predetermined memory area in said display memory according to said predetermined code;

a memory address generator for adding said current horizontal address, said current vertical address and said start address to generate a memory address in said predetermined memory area in said display memory, said memory address being supplied to said display memory so that display data stored in said memory address is outputted from said display memory in a bit-parallel form; and a shift register for converting said display data outputted in bit-parallel form from said display memory into display data in a bit-serial form, said bit-serial display data being supplied to said display means so as to be displayed on said current display position on said display screen;

whereby display data to be displayed in each of said plurality of split blocks on said display screen are supplied from a predetermined one of a pluraity of memory areas defined in said display memory.

10. An apparatus according to claim 9, wherein said vertical address generator comprises a horizontal address width register, a vertical address adder, and a vertical address register, said vertical address adder adding a value stored in said horizontal address width register and a value stored in said vertical address register, said vertical address register storing an output value of said vertical address adder in response to the horizontal synchronizing clock, and the value stored in said vertical address register being outputted as the current vertical address.

11. The apparatus according to claim 9, wherein said block address generator comprises:

a horizontal split data memory storing horizontal split coordinate data;

a horizontal split comparator comparing an output of said horizontal split data memory with the current horizontal address and generating a coincidence signal;

a horizontal split counter counted up by the coincidence signal from said horizontal split comparator;

a vertical split data memory storing vertical split coordinate data;

a vertical split comparator comparing an output of said vertical split data memory with the current vertical line count value and generating a coincidence signal; and a vertical split counter counted up by the coincidence signal from said vertial split comaprator, wherein an output of said horizontal split counter is supplied as an address input to said horizontal split data memory and an output of said vertical split counter is supplied as an address input to said vertical split data memory, said outputs of said horizontal split counter and said vertical split counter being outputted as the current block address.

12. An apparatus according to claim 9, wherein said code converter comprises a block memory for storing a predetermined one of a plurality of codes which correspond respectively to said plurality of memory areas defined in said display memory in each of addresses defined by said block addresses, and for reading out a code stored in an address equal to the current block address supplied thereto, said read out code being outputted as the predetermined code.

13. An apparatus according to claim 12, wherein said memory start address generator comprises a memory start address data memory for storing start addresses of said plurality of memory areas defined in said display memory in addresses defined by said plurality of codes, and for reading out one of the start addresses according to the predetermined code supplied thereto as an address, the read out address being outputted as the start address to the memory address generator.

14. An apparatus according to claim 9, wherein said display memory address generator comprises: a relative address adder adding the current horizontal address and the current vertical address; and an absolute address adder adding an output of said relative address adder and the memory start address thereby to produce the memory address.

15. A display apparatus comprising:

a raster scan display means having a display screen split by predetermined horizontal split ppositions and vertical split positions on said display screen into a plurality of split blocks which are respectively identified by block addresses which are sequentially coded numbers assigned sequentially to said plurality of split blocks;

a display memory for storing graphic data to be displayed on said display screen and character codes corresponding to character fonts to be displayed on said display screen;

a timing generator for generating a horizontal clock, a horizontal synchronizing clock, and a vertical synchronizing clock;

a horizontal address counter which is reset by said horizontal synchronizing clock and which counts said horizontal clock for generating a current horizontal address of a current display position on said display screen;

a vertical line counter which is reset by said vertical synchronizing clock and which counts said horizontal synchronizing clock for generating a current vertical line value indicating a horizontal scanning line on which said current display position exists;

a vertical address generator which is reset by said vertical synchronizing clock and which generates a current vertical address of said current display position on sais display screen which is increased by a value equal to a horizontal across with in response to said horizontal synchronizing clock;

a character vertical address generator for generating a character row address and a character vertical address from said horizontal synchronizing clock;

a block address generator for comparing said current horizontal address with predetermined values indicating said horizontal split positions and for comparing said indicating said vertical split positions, and for generating from the comparison result a current block address indicating one of said plurality of split blocks in which said current display position exists;

a code converter for converting said current block address to a predetermined code corresponding to a predetermined memory area in said display memory in which graphic data to be displayed in the split block identified by said current block address and character codes corresponding to character data to be displayed in the same split block are stored;

a memory start address generator for generating, according to said predetermined code, a start address of said predetermined memory area in said display memory and a character/graphic display switching code indicating which one of graphic data and character data is to be displayed;

a first selector for selector one of said current vertical address and said character vertical address according to said character/graphic display switching code, and for outputting the selected address as a character/graph vertical address;

a memory address generator for adding said current horizontal address, said character/graph vertical address and said start address to generate a memory address in said predetermined memory area in said display memory, said memory address being supplied to said display memory so that data stored in said memory address is outputted in bit-parallel form from said display memory, said data stored in said memory address being graphic data when said character/graphic vertical address is said current vertical address and a character code when said character/graph vertical address is said character vertical address;

a character generator for storing character font data and for outputting one of said character font data in bit-parallel form according to said character row address and said character code outputted from said display memory;

a first shift register for converting said graphic data outputted in bit-parallel form from said display memory into graphic data in a bit-serial form;

a second shift register for converting said character font data outputted in bit-parallel form from said character generator into character data in a bit-serial form; and a second selector for selecting one of said data outputted from said first and second shift registers according to said character/graphic display switching code, and for outputting the selected data to said display means so as to be displayed on said current display position on said display screen;

whereby graphic data to be displayed in each of said plurality of split blocks on said display screen and character codes corresponding to character data to be displayed in said each split block are supplied from a predetermined one of a plurality of memory areas defined in said display memory.

16. An apparatus according to claim 15 wherein said vertical address generator comprises a horizontal address width register, vertical address adder, and a vertical address register, said vertical address adder adding a value stored in said horizontal address width register and a value stored in said vertical address register, said vertical address register storing an output value of said vertical address adder in response to the horizontal synchronizing clock, and the value stored in said vertical address register being outputted as the current vertical address.

17. An apparatus according to claim 15, wherein said character vertical address generator comprises a character row counter which outputs a character pulse and simultaneously resets itself each time when counted up the number of rows of a character, a character horizontal address width register, a character vertical address adder, and a character vertical address register, said character vertical address adder adding a value stored in said character horizontal address width register and a value stored in said character vertical address register, said character vertical address register storing an output value of said character vertical address adder in response to the character pulse, and the value stored in said character vertical address register being outputted as the character vertical address.

18. An apparatus according to claim 15, wherein said block address generator comprises:

a horizontal split data memory storing horizontal split coordinate data;

a horizontal split comparator comparing an output of said horizontal split data memory with the horizontal address and generating a coincidence signal;

a horizontal split counter counted up by the coincidence signal from said horizontal split comparator;

a vertical split data memcry storing vertical split coordinate data;

a vertical split comparator comapring an output of said vertical split data memory with the vertical line count value and generating a coincidence signal; and a vertical split counter counted up by the coincidence signal from said vertical split comparator, wherein an output of said horizontal split counter is supplied as an address input to said horizontal split data memory and an output of said vertical split counter is supplied as an address input to said vertical split data memory, the outputs of said horizontal split counter and said vertical split counter being outputted as the block address.

19. An apparatus according to claim 15, wherein said code converter comprises a block memory for storing a predetermined one of a plurality of codes corresponding to said plurality of memory areas defined in said display memory in each of addresses defined by said block addresses, and for reading out one of the codes stored in an address equal to the current block address supplied thereto, the read out code being outputted as the predetermined code.

20. An apparatus according to claim 19, wherein said memory start address generator comprises a memory start address data memory for storing a plurality of sets of start addresses of said plurality of memory areas defined ins said display memory and character/graphic display switching codes in addresses defined by said plurality of codes, and for reading out one set consisting of a start address and character/graphic display switching code stored in an address equal to the predetermined code supplied thereto as an address, the read out start address being outputted to said memory address generator and the read out switching code being outputted to both said first selector and said second selector.

21. An apparatus according to claim 15 wherein said display memory address generator comprises a relative address adder adding the horizontal address and the character/graph vertical address, and an absolute address adder adding an output of said relative address adder and the memory start address thereby to produce the display memory address.

22. A display apparatus comprising:

a raster scan display means having a display screen split by predetermined horizontal and vertical split positions on said display screen into a plurality of split blocks which are respectively identified by block address which are assigned sequentially to said plurality of split blocks;

a display memory in which a plurality of memory areas are defined, each of said plurality of memory areas having a storage capacity corresponding to a display capacity of said display screen;

a means for generating current horizontal and vertical addresses of a current display position on said display screen and a current vertical line count value indicating a vertical position of said current display position on said display screen;

a block address generating means for respectively comparing said current horizontal address and said current vertical line count value with predetermined horizontal and vertical split values corresponding to said horizontal and vertical split positions, and for generating from the comparison result a current block address indicating one of said plurality of split blocks in which said current display position exists;

a start address data memory for storing start addresses of said plurality of memory areas defined in said display memory;

a code conversion means having a block memory whose addresses are defined by said block address, a predetermined code being stored in each of said addresses of said block memory, said predetermined code being a predetermined one of a plurality of addresses of said start address data memory, wherein said code conversion means outputs said predetermined code according to said current block address supplied thereto as an address, said predetermined code outputted from said code conversion means being supplied as an address to said start address data memory so that one of said start addresses is outputted from said start address data memory as a start address indicating one of said plurality of memory area in which display data to be displayed in one of said plurality of split blocks identified by said current block address are stored;

a memory address generating means for adding said current horizontal address, said current vertical address and said start address outputted from said start address data memory to generate a display memory address of said display memory in which a display data to be displayed on said current display position is stored, said display memory address being supplied to said display memory so that said display data stored in said display memory address is outputted from said display memory to said display means and displayed on said current display position;

whereby display data to be displayed on each of said plurality of split blocks on said display screen are supplied from a predetermined one of said plurality of memory areas defined in said display memory according to contents in said block memory.

23. An apparatus according to claim 22, wherein said start address data memory further stores display switching codes together with said start addresses and outputs one of said display switching codes together with said start address, and wherein said apparatus further comprises:

a character data generating means for generating character data; and a selection means responsive to the switching code outputted from said start address data memory for selecting one of said display data from said display memory and said character data from said character generating means, and supplying the selected data to said display means.

* * * * *